United States Patent [19]

Tada et al.

[11] Patent Number: 4,854,978

[45] Date of Patent: Aug. 8, 1989

[54] MANUFACTURING METHOD FOR HIGH HARDNESS MEMBER

[75] Inventors: Kaoru Tada, Isehara; Masahiko Hasunuma; Mitsuo Kawai, both of Yokohama, all of Japan

[73] Assignee: Kabushiki Kaisha Toshiba, Kawasaki, Japan

[21] Appl. No.: 174,910

[22] Filed: Mar. 29, 1988

[30] Foreign Application Priority Data

Mar. 30, 1987 [JP] Japan ..... 62-76630

[51] Int. Cl.[4] ..... C21D 9/00

[52] U.S. Cl. ..... 148/14; 148/16

[58] Field of Search ..... 148/12.1, 12 R, 13, 148/13.1, 14, 16, 326, 327

[56] References Cited

U.S. PATENT DOCUMENTS 3,277,149 10/1966 Brickner et al. ..... 148/12.1

3,966,509 6/1976 Podgurski ..... 148/16

FOREIGN PATENT DOCUMENTS 60-36648 2/1985 Japan .

*Primary Examiner*—Deborah Yee

*Attorney, Agent, or Firm*—Foley & Lardner, Schwartz, Jeffery, Schwaab, Mack, Blumenthal & Evans

[57] ABSTRACT

A metal molded shape having a high hardness surface layer which is hard to work is obtained by casting an easy to work alloy member into a desired molded form, and then changing the composition of the member surface by volatilizing off the high vapor pressure elements, carried out by subjecting the easy to work alloy member, to a heat treatment at high temperature.

5 Claims, 1 Drawing Sheet

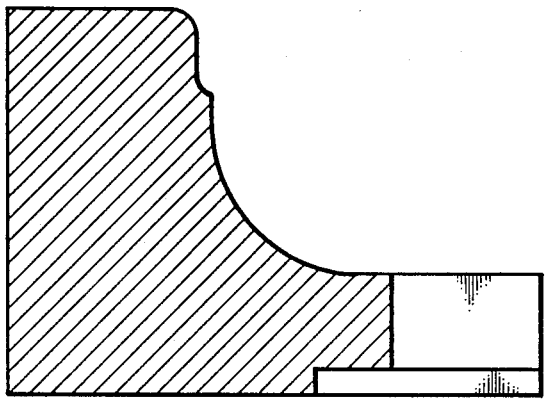

MANUFACTURING METHOD FOR HIGH HARDNESS MEMBER

BACKGROUND OF THE INVENTION

Field of the Invention

The present invention relates to a method of manufacturing high hardness memebers which may be used for various kinds of tools, machines, and the like.

Description of the Prior Art

As a material for cutting tools, which require a high hardness, and for abrasion-resistant tools, such as various kinds of dies and pressed tools, there has been known in the past a hard material of WC-CO composition. Because this material is hard to work, it is not easy to form the material by casting, forging, etc. For this reason, the process of powder metallurgy is employed. Since, however, powder metallurgy requires strict control over the nature of the raw material powder and the particle size of carbide, the carbon content, and the type of the sintered alloy, there has been a demand for a high hardness material which is inexpensive as well as easy to work with that does not use powder metallurgy processes.

On the other hand, a high hardness iron-based alloy, high speed steel, which is machine workable, has been in existence for some time. However, high speed steel has a lower hardness which is less than about one-half of that of hard metals, so an iron-based alloy with a higher hardness has been desired.

Intermetallic compounds have also been known as high hardness materials, but they have a problem in that they are extremely difficult to work elastically because of their brittleness.

In addition, there has been known a method in which a high hardness member is obtained by subjecting an easy to work alloy to a surface treatment after forming. For such surface treatment, two methods are known: ion implantation and plating. The ion implantation method has a disadvantage in that sufficient hardness cannot be obtained because the ion implanted layer tends to be broken under loading due to the very small thickness of the layer. The plating method has a problem in that the plating of a high hardness alloy tends to peel off under laoding It is an object of the present invention to provide a method of making a high hardness product which is not subject to the foregoing disadvantages.

These and other objects, features and advantages of the present invention will be more apparent from the following description of a preferred embodiment, taken in conjunction with the accompanying drawing.

BRIEF DESCRIPTION OF THE DRAWINGS

The drawing is a sectional view of a mold to which is applied the present invention.

SUMMARY OF THE INVENTION

It is an object of the present invention to solve the existing problems described above, and to provide a method of manufacturing a high hardness member which has satisfactory workability and a hardness higher than that of high speed steel.

It is another object of the present invention to provide a method of manufacturing a high hardness member whose high hardness layer on the surface will not peel off.

The feature of the present invention is to propose a method of manufacturing a high hardness member, obtained by forming a high hardness surface layer that is hard to work. This is accomplished by changing the composition of the member surface through volatilization of elements with high vapor pressure, carried out by subjecting the easy to work alloy member worked into a desired form to a heat treatment at high temperature.

As an easy to work member, for example, it is preferred to use an iron-based alloy whose weight ratio composition consists of 10%–30% manganese, 10%–30% chromium, less than 2% carbon, and the remainder substantially iron. The limitation on the composition of such an iron-based alloy will now be described below.

Carbon is an important element for obtaining the easy to work of the member and is volatilized for forming the high hardness surface layer. If the amount of carbon with such properties exceeds 2 weight %, there arises that the hardness of the surface layer, which is formed by high temperature heating, may not be raised to a sufficiently high level. The preferred amount of carbon is 0.01 weight %–1 weight %.

Manganese is an important element which is for obtaining the easy to word of the member and is volatilized for forming the high hardness surface layer. When the compounding ratio of manganese with such properties is less than 10 weight %, the high hardness surface layer is not obtained, thereby reducing the strength and hardness of hte member, whereas if the compounding ratio exceeds 20 weight %, there arises that the workability of the austenite might be impaired to work easily. The preferred range for manganese is 15 weight %–25 weight %.

By means of high temperature heat treatment, at least one of the carbon and manganese, which have high vapor pressures, are volatilized off the surface of the easy to work member, reducing the contents of carbon and manganese in the surface, and surface layer with high hardness is formed.

Chromium is an element, along with manganese which is volatilized, which is necessary for forming the high hardness surface layer to improve strength and hardness. When the amount of chromium is less than 10 weight %, the workability of the member is impaired and strength, hardness and corrosion resist are reduced, whereas if the amount of chromium exceeds 30 weight %, the hardness layer can not obtain and the member decreases the toughness. The preferred range is 15 weight %–25 weight %.

An easy to work member may be formed from an iron-based alloy with the composition mentioned before, to which is added less than 10 weight % of nickel, less than 5 weight % of vanadium, and less than 5 weight % of copper. The limitation of these components is described as follows.

Nickel is an element which improves toughness. If it exceeds 10 weight %, not only does its effect become saturated, but it also makes it difficult to manufacture a member with satisfactorily high hardness due to undesirable composition balance with other components.

Vanadium is an element which improves strength and hardness of the member, but if it exceeds 5 weight %, workability is impaired.

Copper is an element which improves toughness. If it exceeds 5 weight %, the hardness of the surface layer formed by high temperature heating may not be enhanced to a sufficiently high level.

Other elements which do not disturb the forming of the high hardness surface layer may be contained in the easy to work member.

As for heat treatment, it is desirable to carry out such vaporizing heating within the temperature range of 900° C.–1300° C. The reasons for this are that if the temperature is below 900° C., it becomes difficult to form a layer of high hardness on the surface of the easy to work alloy member without enough volatilization, whereas if the temperature exceeds 1300° C., it may adversely thermally affect the easy to work alloy itself. It is desirable to carry out such a thermal treatment in a vacuum or in an inert gas environment. According to the present invention, by changing the composition (more specifically, in the case of the previously mentioned alloy of carbon, manganese, chromium, and the remainder iron, the amounts of carbon and manganese are decreased and amounts of chromium and iron are relatively increased) of the surface of the member, after machining into a desired shape and subsequent heat treatment at a prescribed temperature, it is possible to form a hard to work surface layer with a high hardness. Accordingly, a member of arbitrary shape can be formed simply by carrying out a machining process or by casting and forging or cutting and grinding, without employing powder metallurgy, which is complicated to control as was mentioned in the case of hard metals. Moreover, a surface layer with a hardness higher than that of existing high speed steel can be formed by heat treatment, so that it is possible to manufacture a high hardness member of an arbitrary shape in an extremely easy manner.

According to the present invention, it is possible to carry out a surface polishing process such as a lapping without a major shape working after a heat treatment.

According to the present invention, it is possible to reform a high hardness surface layer on the member with a heat treatment after the member is used as a high strength member. More particularly, there are three methods of the reforming as follow. In a first method, the used high strength member with a deteriorated high hardness surface layer is subjected to a heat treatment being in a range of 900° C.–1300° C. to reform a high hardness surface layer on the member. In a second method, a deteriorated high hardness surface layer of the used high strength member is removed by a machining. After that, the member is subjected to a heat treatment being in a range of 900° C.–1300° C. to reform a high hardness surface layer on the member. In a third method, the used high strength member is subjected to a heat treatment at a temperature lower than 900° C. to obtain a new easy to work member. After the member is worked to another desired shape, the member is subjected to a heat treatment being in a range of 900° C.–1300° C. to reform a high hardness surface layer on the member.

Moreover, according to the present invention, it is possible to freely control the thickness of the surface layer that has high hardness, simply by adjusting the temperature and the duration of the heat treatment.

DETAILED DESCRIPTION OF THE PREFERRED EMBODIMENTS

The embodiments of the present invention will be described in detail in what follows.

Examples 1–4

After melting the iron-based alloy of each of the 4 kinds of compositions, as shown in the following table, by the use of a high frequency induction furnace, and forging the melted alloys to obtain their ingots, 4 kinds of easy to work alloy members were obtained by giving them hot forging. Next, by machining each of these easy to work alloy members into the mold shapes as shown in the drawing, 4 kinds of metal molds were obtained. Then, after heating each metal mold at 1150° C. for 2 hours in a vacuum, and followed by slow cooling, a portion of each metal mold was cut out to measure the surface hardnesses with a Vickers hardness tester and to measure the composition and the thickness of each surface layer. The results of the measurements are summarized in the table. For comparison, the composition and the thickness of a commercially available high speed steel (SHK2) are also included in the table.

TABLE

| | Chemical Composition (weight %) [Upper Line for Matrix composition / Lower Line for Surface Layer Composition] | | | | | | | Matrix Hardness | Surface Layer Hardness | Surface Layer Thickness |
|---|---|---|---|---|---|---|---|---|---|---|
| | C | Mn | Cr | Ni | V | Cu | Fe | (Hv) | (Hv) | (μm) |
| Example 1 | 0.50 | 22.1 | 20.9 | — | — | — | Balance | 370 | 880 | 50 |
| | 0.41 | 14.4 | 25.2 | — | — | — | " | | | |
| Example 2 | 0.63 | 20.3 | 22.6 | — | — | — | " | 340 | 900 | 60 |
| | 0.42 | 10.1 | 24.8 | — | — | — | " | | | |
| Example 3 | 0.42 | 21.3 | 20.6 | 4.21 | 1.76 | — | " | 400 | 920 | 40 |
| | 0.30 | 14.5 | 23.8 | 4.22 | 1.59 | — | " | | | |
| Example 4 | 0.58 | 20.7 | 22.0 | 3.63 | 2.08 | 1.51 | " | 350 | 960 | 55 |
| | 0.42 | 13.4 | 24.6 | 3.58 | 2.12 | 1.46 | " | | | |
| Comparative Example | 0.73 | — | 4.2 | — | 1.01 | W 18.4 | " | 750 | 750 | — |

As may be clear from the table, it is understood that in the metal molds of examples 1–4, in accordance with the present invention, the surface layers formed had hardness higher than that of the high speed steel.

In summary, according to the present invention, itis possible to obtain a high hardness member having a surface layer with a hardness higher than that of high speed steel, in an extremely easy manner. This leads to conspicuous effects that enable it to be effectively utilized for wear-resistant tools such as cutting tools, various kinds of dies, and pressed tools, and for other machines or the like which require wear resistance.

Various modifications will become possible for those skilled in the art after receiving the teachings of the present disclosure without departing from the scope thereof.

What is claimed is:

1. A method of manufacturing a high hardness product from an easy to work alloy member comprising less than 2 weight % carbon, 10–30 weight % manganese, 10–30 weight % chromium, and the remainder substantially iron, comprising the steps of:

(a) forming said easy to work alloy member; and (b) subjecting the formed alloy member to a heat treatment to volatilize high vapor pressure elements comprising at least one of carbon and mangagnese in the alloy member and to form a high hardness surface layer by changing the surface composition of the alloy member.

2. The method of manufacturing a high hardness product as claimed in claim 1, wherein the high hardness surface layer is formed by subjecting the formed alloy member to a heat treatment at high temperature to volatilize high vapor pressure elements comprising carbon and manganese to obtain, at the surface, a composition which contains relatively less carbon and manganese as compared with the balance of said member.

3. The method of manfacturing a high hardness product as claimed in claim 1, wherein said easy to work alloy member is formed into a metal mold.

4. The method of manufacturing a high hardness product as claimed in claim 1, wherein the easy to work alloy member comprises less than 2 weight % of carbon, 10–30 weight % of manganese, 10–30 weight % of chromium, less than 10 weight % of nickel, less than 5 weight % of vanadium, less than 5 weight % of copper, and the remainder substantially iron.

5. A method according to claim 1, wherein said easy to work alloy member comprises 0.01 to 1 weight % carbon, 15 to 25 weight % manganese and 15 to 25 weight % chromium.

* * * * *